US006480109B1

(12) United States Patent
Tice

(10) Patent No.: US 6,480,109 B1
(45) Date of Patent: Nov. 12, 2002

(54) ALARM LOCKOUT APPARATUS

(75) Inventor: Lee D. Tice, Bartlett, IL (US)

(73) Assignee: Pittway Corporation, Chicago, IL (US)

( * ) Notice: Subject to any disclaimer, the term of this patent is extended or adjusted under 35 U.S.C. 154(b) by 0 days.

(21) Appl. No.: 09/488,214

(22) Filed: Jan. 19, 2000

(51) Int. Cl.[7] ..... G08B 29/00

(52) U.S. Cl. ..... 340/506; 340/517; 340/521; 340/522

(58) Field of Search ..... 340/506, 511, 340/517, 521, 522, 524, 533

(56) References Cited

U.S. PATENT DOCUMENTS 4,688,021 A 8/1987 Buck et al.
4,792,797 A 12/1988 Tanguay et al.
4,827,244 A 5/1989 Bellavia et al.
5,400,246 A * 3/1995 Wilson et al. ..... 340/825.06 X

FOREIGN PATENT DOCUMENTS

GB 2 207 789 A 2/1989

OTHER PUBLICATIONS

European Search Report for European Patent Application 01300378.5–2215–, which claims priority from USSN 09/488,214.

* cited by examiner

*Primary Examiner*—Daryl Pope
(74) *Attorney, Agent, or Firm*—Welsh & Katz, Ltd.; Paul M. Vargo

(57) ABSTRACT

A multi-mode electrical device for a communications system exhibits at least two different modes manually selectable at the device. A mode setting switch carried by the device has at least two states. One state is associated with a normal operational mode. A second state is associated with a different operational mode. A movable member carried by the device's housing can be used to select the mode.

90 Claims, 3 Drawing Sheets

ALARM LOCKOUT APPARATUS

FIELD OF THE INVENTION

The invention pertains to ambient condition detectors. More particularly, the invention pertains to such detectors which incorporate maintenance enhancing circuitry.

BACKGROUND OF THE INVENTION

Known monitoring systems can be installed in and used to monitor a variety of conditions in a region such as some or all of a building. Such systems, for example, fire alarm or burglar alarm systems, provide on-going indications as to the presence of certain pre-defined conditions. Representative conditions include the presence of fire, such as perhaps indicated by the presence of heat or smoke, or the presence of intruders into a region such as might be indicated by infrared radiation emitted from persons or animals in a region being monitored.

Known systems usually include a plurality of ambient condition detectors which are often dispersed throughout the region. It is also known that such detectors from time to time may need replacement or maintenance. Known types of maintenance include repair or replacement of components in a respective detector or cleaning same.

Detectors may communicate wirelessly or by a wired medium such as an optical or an electrical cable. In wired systems, the detectors can be hardwired to the medium. In such instances, depending on the design of the system, it may not be possible to continue normal system operation with respect to remaining detectors when one of the detectors is disconnected for maintenance or replacement purposes. There is also the inconvenience and time involved in having to disconnect/reconnect the detectors.

Additionally, even if it might be possible to carry out the maintenance work while the respective detector is connected into the system, with the system remaining operational, such activities may increase the likelihood of false alarms which are undesirable.

It is also known in some systems to provide detectors which removably engage respective bases. The respective base or bases can be coupled to one another or to displaced control elements via respective cables. In such installations, a detector which has been removed for maintenance can be temporarily replaced by another unit if desired. Often such systems include circuitry or executable instructions which enable the respective system to continue with substantially normal operation even if the location of a detector which has been removed for maintenance is not temporarily filled with a substitute.

Adverse consequences may result even in systems which incorporate detectors which are removably coupled. For example, where the systems include one or more computers or programmed processors which are executing instructions, the software might receive erroneous signals or messages due to the temporary removal of one or more detectors. Potential problems might include causing software to inappropriately reset with a loss of previously stored data, communications or timing. Thus, even where the detectors are intended to be removably coupled to a system, there are benefits in not having to remove them to carry out routine maintenance.

There continues to be a need for devices which can be temporarily disabled, without physically having to remove the device from the system, for purposes of routine maintenance. Preferably, the existence of such structures would be substantially transparent to other detectors or system control elements. Additionally, it would be preferably if such structures could be incorporated into detectors without substantially increasing either the cost or the manufacturing complexity thereof. Finally, it would be preferable if such structures did not adversely affect the external aesthetic appearance of the respective detectors.

SUMMARY OF THE INVENTION

Structures and methods in accordance with the present invention contribute to being able to perform maintenance on electrical devices which are part of a multi-device communication system without disabling or causing a loss of power to any portion of the respective system to which a respective device receiving maintenance is interconnected. Additionally, the respective device continues to receive power and can carry out maintenance related functions, if desired, during the maintenance procedure.

In a preferred embodiment, a switch element which has at least two states is incorporated into the electrical device. The state of this switch can be manually or automatically changed at the beginning of a maintenance procedure.

The change of state provides a signal to the respective device that it has gone from a normal operational mode to a maintenance mode. In a maintenance mode, the respective device will not necessarily emit the same output signals as in a normal operational mode. The maintenance mode output signals can not only be used to inform other devices in the system that the respective device is undergoing maintenance but also the likelihood that false or inappropriate signals or messages will be emitted from a device undergoing maintenance is substantially reduced.

In yet another aspect, a monitoring system includes a plurality of ambient condition detectors. At least some of the detectors include control circuitry having a normal operational mode and a maintenance mode. The respective detector or detectors can be placed into the maintenance mode by actions taken locally in the vicinity or at the detector.

In a preferred embodiment, a switch is used to indicate that maintenance is being performed on a device. This switch may be manually activated or automatically activated during the maintenance procedure.

One method of automatically operating the switch is to detect the removal of a cover or another part that is normally removed or moved in position during the maintenance procedure. Other structures for detecting the changing in position of parts of the device during a maintenance procedure are also within the spirit and scope of the present invention.

Switches of various types, mechanical, magnetic, proximity, or optical, can be used to detect the maintenance processes. A mechanical switch could include metal contacts or carbon rubber or other conductive medium that shorts out points on a printed circuit board. Other types of switches can also be used, including multi-state (more than two state) switches. An example of another approach could be by monitoring the position of a part optically and noting a change in the optical signal. The switch could be manually activated or automatically activated.

The switch is placed into a maintenance state, at the start of the maintenance process, to disable the device from exhibiting alarm or other environmental indications. The switch is returned to its normal state after servicing.

In one embodiment, a change of state of a switch in the device can result in a message transmission to some external device. That external device, such as a system control unit, could then send a message back to the respective device (containing the switch whose position was changed) to not send alarm indications. This method includes the control unit or other external device in the process of disabling alarm indications when the device is placed into a maintenance mode.

In another embodiment, a change of state of a switch in a device can result in a message transmission to some external device. That external device, such as a system control unit, could then ignore alarm transmissions or indications from the respective device. When the switch is changed back to its normal position, the device can transmit a message indicating that it has returned to a normal operational state. The external device would then no longer ignore alarm transmissions or indications.

A time delay can be used with the switch function. This delay will permit an alarm indication to be transmitted after a predetermined period of time during which the maintenance is to be performed. This time delay is not necessary if the system can recognize that the maintenance is taking place and appropriate indications are given. However, if the system cannot recognize that the device has been disabled from giving an environmental condition indication, then a fail safe can be provided. In this instance, the switch function is automatically returned to normal after a predetermined period of time regardless of whether the service has been completed.

In a preferred approach, the switch would be incorporated into the device and automatically change state when the cover or some other part is removed or changed in position during maintenance. Automatic operation of the switch would make it easier for the person performing the maintenance. In addition, automatic operation will minimize the likelihood of service personnel creating false alarms by failing to place the device in the maintenance mode prior to servicing it.

Products that are hardwired and not easily removable benefit from this invention. Duct detectors, power devices, and hardwired sensors are examples. In the case of the duct detector, when the cover is removed for maintenance, the circuitry is disabled from indicating an alarm condition.

In an alternate application, the device itself could monitor what maintenance was performed, store this information, and possibly report it to an external device. The reporting could be automatically activated or activated by request messages or other request indicators. The external device could be a control unit connected to the communications link, a portable device that accesses the information, or a modem link to a remote location.

A device with the cover removed could provide an audible or visual (or both) indication that the monitoring function (i.e. smoke) has been disabled (as long as the cover is not in place). A rapidly pulsing light emitting diode could be a visual indication of the device being disabled from detecting environmental conditions. A color change (i.e. yellow) could indicate this same condition. A "chirping" horn could indicate that the device is disabled from detecting environmental conditions. Many different methods of indication can be used including digital/analog displays.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
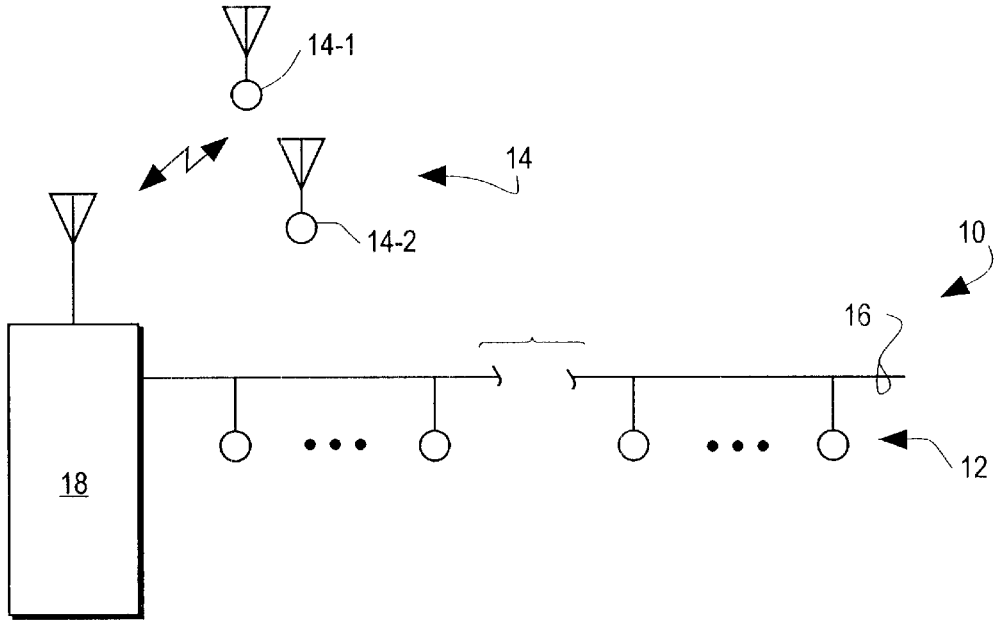
FIG. 1 is a block diagram of a system in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a system 10 in accordance with the present invention. System 10 is a multi-device communication system which includes first and second pluralities of devices 12, 14.

Devices 12 communicate via an optical or electrical cable 16. If desired, a system control element 18 could also be coupled to medium 16. Devices 14 communicate wirelessly with one another and with element 18.

Some or all of devices 12, 14 can include transducers such as ambient condition sensors. These include fire, gas, motion, flow and position sensors without limitation. Others can include transducers such as audible or visible output devices, or motion inducing devices such as solenoids.

Devices 12, 14 can carry out communication with one another or with element 18 using a variety of communications protocols and technologies all without departing from the spirit and scope of the present invention. Further, except as discussed herein, the detailed structures of devices 12, 14 are not limitations of the present invention.

Devices 12 can be coupled to medium 16 substantially permanently, hard wired, or releasibly coupled to bases which are hardwired to medium 16. The exact connections of devices 12, 14 are not limitations of the present invention.

During normal operation, pluralities 12, 14 carry out their respective types of normal processing and communicate wirelessly or via medium 16. In situations where there is a need to replace or service one of the devices 12, 14 the respective device can be taken off line or caused to enter another, for example, a maintenance mode.

Entering or exiting other modes can cause messages to be transmitted from the respective device via the medium to other devices or to control element 18. The messages provide information to other system devices as to the status of the respective device. As a result, messages or signals from the respective device which are inconsistent with an off-line or service status can be ignored. Hence, if one of the devices is a fire detector which has been placed into a maintenance mode for cleaning, any fire indicating messages or signals from that detector, while in that mode, could be ignored., Since the respective device or devices still are energized while in the alternate mode, they will continue to function normally for that particular mode of operation. Thus there should be no losses of data, timing or sequencing information anywhere in the system. It will be understood that a given device or devices could exhibit a plurality of operational modes without departing from the spirit and scope hereof.

Figure 2:
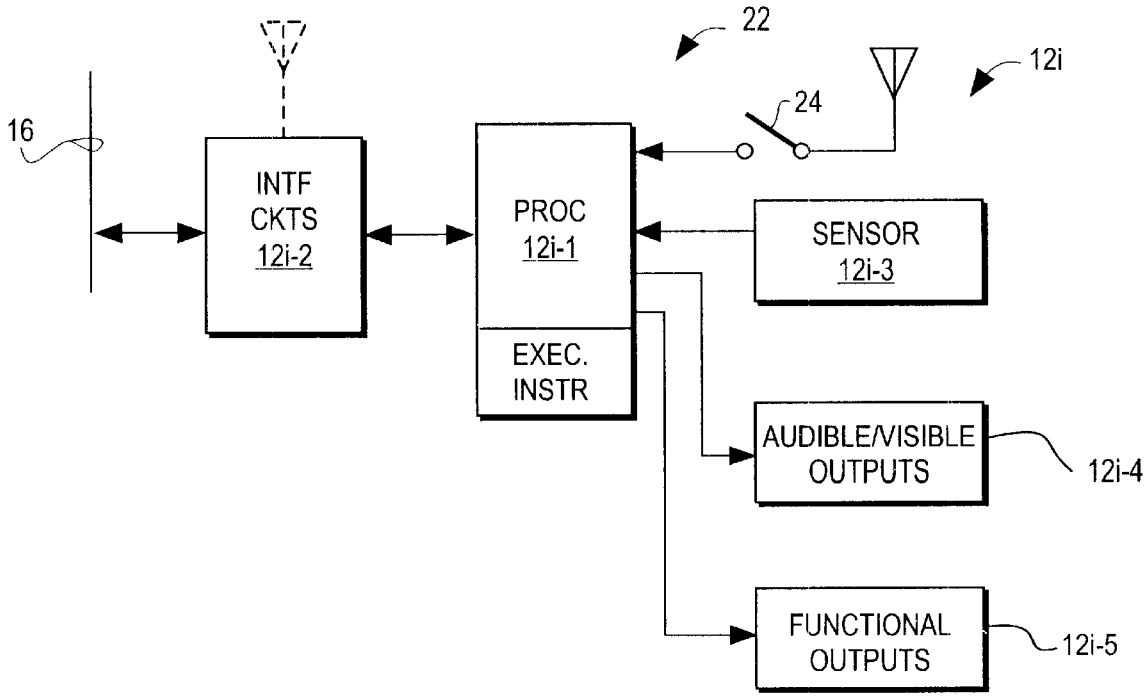
FIG. 2 is a block diagram of device usable in the system of FIG. 1.

FIG. 2 illustrates one of the devices 12*i* in block diagram form. Device 12*i* includes a programmed processor and executable instructions 12*i*-1. Storage circuitry is also coupled to that processor.

Processor 12-*i*-1 is coupled to interface circuitry 12*i*-2. The interface circuitry 12*i*-2 can communicate with medium 16 or wirelessly using an antenna, illustrated in phantom.

Where appropriate, device 12*i* can incorporate one or more transducers such as sensor 12*i*-3. Device 12*i* also includes a manually operable assembly 22 which can be used to change the operational mode of that device 12*i*. Assembly 22 can include, for example, a switch 24 coupled to processor 12*i*-1. Switch 24 could have two states corresponding to at least two different operational modes for detector 12*i*. Without limitation, one mode can correspond to a normal operational mode for the device. Another can correspond to an off-line, or a maintenance mode of operation.

Depending on the signal or signals received by the processor 12-*i*, a mode of normal operation or off-line, maintenance operation can be implemented. Hence, in normal operation, processor 12*i* will execute instructions which respond to signals received from sensor 12*i*-3 and instructions which carry out various types of processing of signals therefrom. The results of such processing can be coupled by medium 16, or, wirelessly to other devices such as element 18.

One form of processing that could be carried out by processor 12-*i* is disclosed in U.S. Pat. No. 5,612,674 entitled "High Sensitivity Apparatus and Method With Adjustment for Noise". The '674 patent is assigned to the assignee hereof and is hereby incorporated by reference. Other forms of processing can also be implemented by processor 12*i* without departing from the spirit and scope of the present invention.

Where sensor 12*i*-3 is, for example, a smoke sensor, the results of processing the signals therefrom could be coupled to other devices 12 or element 18. In such instances, in normal operation, element 18 might determine that a fire condition has been detected and take appropriate steps. On the other hand, if detector 12*i* was scheduled for routine maintenance, which might include cleaning sensor 12*i*-3, signals from device 12*i* might inaccurately indicate the presence of a fire. Such false alarms are undesirable.

Detector 12*i* can be placed into a maintenance mode, before being subjected to maintenance, by changing the state of switch 24. In this mode, processor 12*i*-1, upon detecting the change of state of switch 24 can send a selected message to element 18 indicating that it had entered a maintenance state. Alternately or in addition, while in the maintenance mode, transmission of signals from sensor 12*i*-3 could be suspended or suppressed. Thus while in this mode, undesirable signals can be blocked or suppressed in device 12*i* thereby minimizing the likelihood of false alarms being transmitted to element 18 or to other devices.

Device 12*i* could also carry audible or visible output devices 12*i*-4. The output devices which operate under the control of processor 12*i*-1, can be used to provide a local audible or visible indication of the current operational mode. For example, an audible horn or speaker of some type could be used to provide an audible status indicating message. A light emitting diode can be blinked at different rates to indicate status. Alternately, different colors can be used to indicate status.

It will also be understood that device 12*i* could carry an output transducer 12*i*-5 as an alternate to or in addition to sensor 12*i*-3. It will also be understood that device 12*i* could carry multiple sensors or transducers.

Figure 3A:
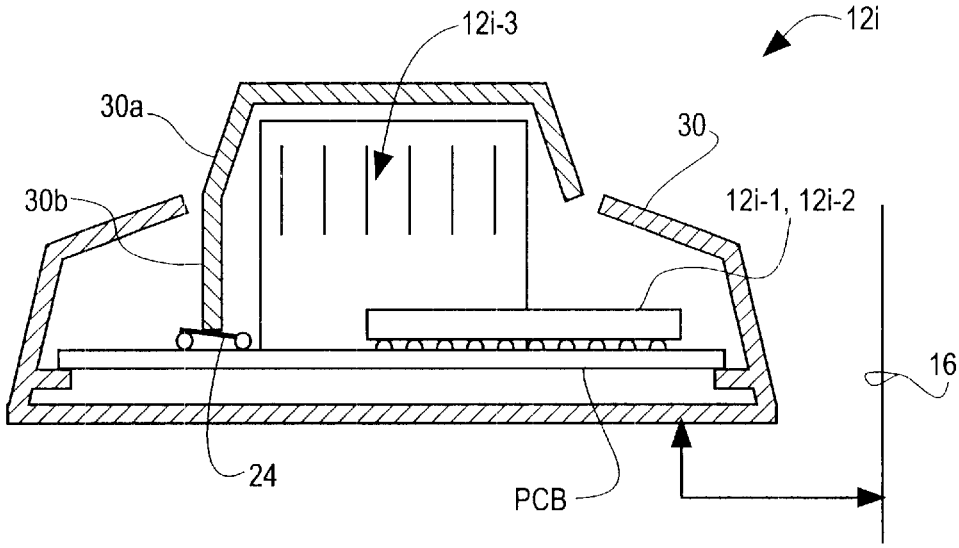
FIG. 3A is a side sectional view of the device of FIG. 2 when in a normal operational mode.

FIG. 3A illustrates additional details of the device 12*i*. The device includes a housing 30 which includes components of the device. Housing 30 could, for example, be mounted to a ceiling or a wall adjacent to a ceiling.

Housing 30 carries a movable cover 30*a*. Cover 30*a* has at least two positions. In one position, cover 30*a* engages switch 24, perhaps via extension 30*b* to cause switch 24 to exhibit a first state, which might correspond to a normal operating mode. In FIG. 3A switch 24 is illustrated in a closed state. It will be understood that this is exemplary only and is not a limitation of the invention. Switch 24 could have been illustrated in an open state in FIG. 3A.

Switch 24 can be implemented with any conventional switch technology such as mechanical, contact switches, or, non-contact switches such as magnetic, optical, proximity or any other type of non-contact technology without departing from the spirit and scope of the present invention. Housing 30 carries a sensor, such as the sensor 12*i*-3. It also carries control circuitry and interface circuitry, corresponding for example to elements 12I-1 and 12I-2 without limitation.

Device 12*i* can communicate via wired medium 16 or wirelessly. When configured as in FIG.3A, device 12*i* can function in a normal operational mode and, depending on sensor output, which could be processed therein, communicate ambient condition information such as the existence of various pre-alarm or alarm states to other devices or to element 18.

Figure 3B:
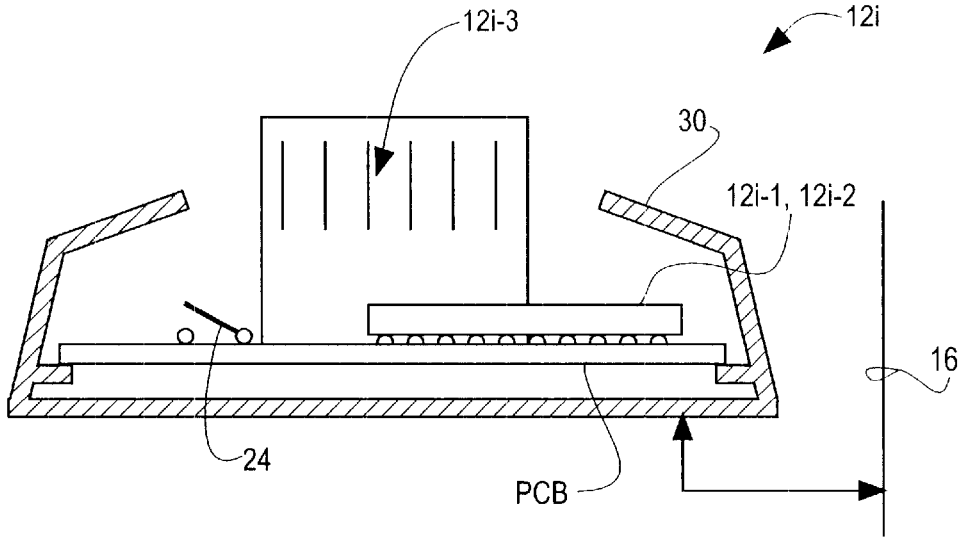
FIG. 3B is a side sectional view of the device of FIG. 2 when in an off-line or maintenance mode.

FIG. 3B illustrates device 12*i* with housing 30 rotated out of the way or removed. In this instance, switch 24 has assumed a different state than as in FIG. 3A.

The different state, which could be associated with a maintenance procedure, can be detected by the control circuitry, such as circuitry 12*i*-1,. In response to detecting this different state, control circuitry 12*i*-1 can switch to a maintenance mode, or any other mode indicated by the state of switch 24, and send a message wirelessly or via medium 16 to other devices. Additionally, circuitry 12*i*-1 can suppress the transmission of messages indicative of sensor output until the maintenance procedure has been completed.

Completion of the procedure is indicated by a return of the housing portion 30*a* to the state illustrated in FIG. 3A. When switch 24 again assumes its closed state, as in FIG. 3A, circuitry 12*i*-1 returns to its normal operating mode. It can send an appropriate message to other devices or to the element 18. Then, it can again initiate transmission of sensor related output information.

Other forms of operation are possible. Circuitry 12*i*-1 can include a timer. If desired, device 12*i* will always return to its normal operating mode after a predetermined time interval. The element 18 will then start to receive sensor related information even if the maintenance process is still underway.

In yet another form of operation, the respective devices can transmit messages indicating each change in operational mode to element 18. Element 18 can in turn determine how, if at all to respond to various other messages which might be received from the device while in one operational mode or another.

Figure 4A:
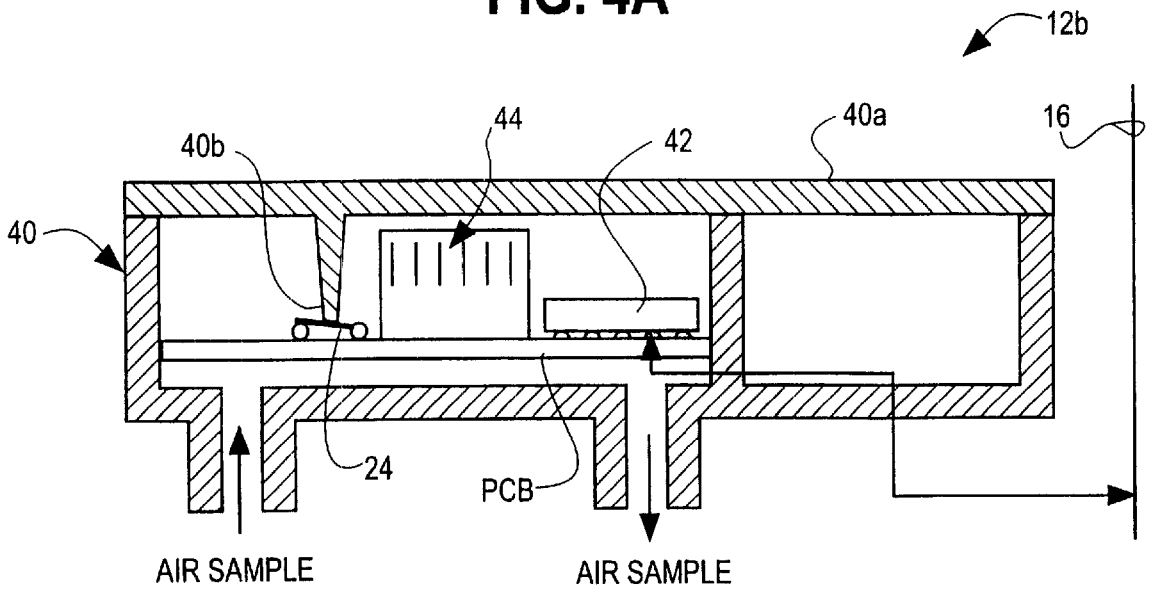
FIG. 4A is a side sectional view of another type of device usable in the system of FIG. 1 when in a normal operational mode.
Figure 4B:
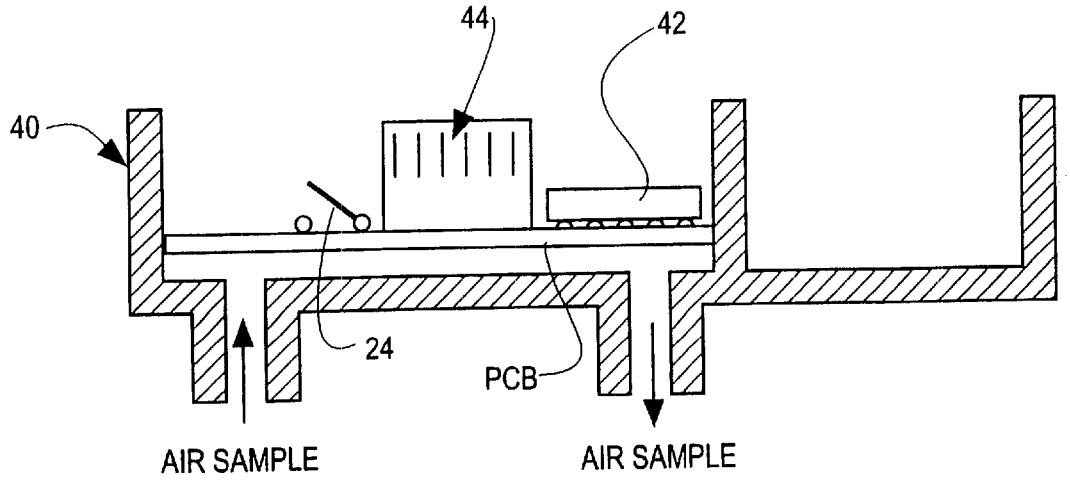
FIG. 4B is a side sectional view of the device of FIG. 4A when in an off-line or maintenance mode.

FIGS. 4A and 4B illustrate two different states for another electrical device, a duct detector 12*k*. Such detectors are disclosed in U.S. Pat. No. 5,844,148, Detector With Adjustable Sampling Tubes", assigned to the assignee hereof and incorporated by reference herein.

Detector 12*k* includes a housing 40 with a removable cover 40*a*. Cover 40*a* carries an extension 40*b* which can be used to change the state of switch 24.

As illustrated in FIG. 4A when cover 40*a* is in place, switch 24 exhibits a first state. When the cover 40*b* is removed for service, as illustrated in FIG. 4B, the switch 24 assumes a second state.

As discussed above, the different states of switches 24 can be detected by local control circuits 42. Local control circuits 42 can then transmit messages or indicia via either a wireless medium or wired medium 16 to other devices in plurality 12 or to control element 18. In addition, circuits 42 can continue to monitor outputs from a local transducer, illustrated for example as sensing chamber 44. Circuits 42 can continue to transmit information concerning local transducer performance to remote devices, or can suppress such transmissions until either a predetermined time interval has passed or cover 40*a* has been replaced.

Circuitry 42 can store maintenance or service information in a local log. Alternately, information concerning such service can be transmitted to remote devices. Circuitry 42 can also energize a local "out of service" or maintenance indicating audible or visible outputs. Circuits 42, which could include a programmed processor can also carry out local processing of transducer outputs.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. An electrical unit comprising:

a housing;

a transducer carried by the housing;

control circuitry having at least two states, responsive to transducer condition, and coupled to the transducer;

a multi-position switch coupled to the circuitry wherein the housing carries a movable portion and switch position is responsive to the movable portion whereby, when the switch is in a first position, the circuitry can exhibit any one of the states, and when the switch is in a second position, the circuitry enters a maintenance mode and exhibits only one state irrespective of transducer condition.

2. A unit as in claim 1 wherein in response to a position change, the circuitry externally transmits a selected indicium.

3. A unit as in claim 1 wherein the control circuitry includes a programmed processor responsive to the changes of position.

4. A unit as in claim 1 wherein the transducer comprises a sensor and, in response to the presence of a selected ambient condition, the control circuitry changes state.

5. A unit as in claim 4 wherein when the switch is in a maintenance position, the presence of the ambient condition is not discernable externally of the unit.

6. A unit as in claim 1 wherein the movable portion is slidably carried on a base.

7. A unit as in claim 1 which includes at least one of an audible indicator of the position and a visible indicator of the position.

8. A unit as in claim 4 wherein the sensor is selected from a class which includes a smoke sensor, a gas sensor, a thermal sensor, a position sensor, a flow sensor and a motion sensor.

9. A unit as in claim 1 wherein the element is movable on the unit but remains coupled thereto.

10. A unit as in claim 1 wherein the control circuitry includes a storage element for storing information pertaining to the alternate functioning of the unit.

11. A method of operating a multi-device communication system comprising:

operating the system with the devices in a normal operational mode;

altering a housing portion's location on a selected device thereby placing that device into a different operational mode;

continuing to operate the system with the remaining devices in their respective normal operational modes with the selected device continuing to operate in the different operational mode.

12. A method as in claim 11 including manually performing a maintenance function on the selected device while it continues to operate in the different operational mode.

13. A method as in claim 11 which includes uncoupling the selected device from the system while in the different operational mode.

14. A method as in claim 11 which includes, at the selected device, sensing an ambient condition.

15. A method as in claim 14 which includes processing indicia of the sensed ambient condition at the selected device at least when in the normal operational mode.

16. A method as in claim 14 which includes suppressing at least some ambient condition-related output signals from a device when in the different operational mode.

17. A method as in claim 11 which includes restoring the selected device to the normal operational mode.

18. A method as in claim 17 which includes, while the selected device is in the different operation mode, suppressing at least some signals that might have been output had the device been in a normal operational mode.

19. A method as in claim 11 which includes providing a common control element, in communication with the devices.

20. A method as in claim 11 wherein when the selected device enters the different operational mode, it transmits a corresponding indicium.

21. A method as in claim 20 wherein when the selected device exits the different operational mode it transmits a corresponding indicium.

22. A unit as in claim 1 wherein the element is removable from the unit.

23. A communication system comprising:

a plurality of coupled electrical devices wherein at least some of the devices, when in a first mode, transmit status related information to at least one other device, wherein selected of the devices can be placed into a second off-line service mode, at the respective device, for service without uncoupling the device from the plurality and wherein responsive to entering the second mode, the respective device communicates at least a status message indicating that it has entered the second mode.

24. A system as in claim 23 wherein some of selected devices include transducers.

25. A system as in claim 24 wherein some of the transducers comprise ambient condition sensors.

26. A system as in claim 23 wherein the selected devices communicate when exiting the second mode, to at least one other device.

27. A system as in claim 25 wherein selected of the devices include circuitry for processing signals for the respective sensors.

28. A system as in claim 25 wherein the selected devices include circuitry for transmitting signals indicative of outputs from the sensors when the respective device is in the first mode.

29. A system as in claim 28 wherein the selected devices, when in the second mode, do not transmit the same sensor indicative signals as when in the first mode.

30. A system as in claim 23 wherein the at least some devices each include a manually operable, movable element for changing device modes.

31. A system as in claim 30 wherein the manually operable element comprises a movable housing portion of the respective device.

32. A system as in claim 30 wherein the respective device includes a housing and wherein the manually operable element is movably carried on a portion of the housing.

33. A system as in claim 30 wherein movement of the movable element changes state of one of a mechanical switch, a magnetic switch, an optical switch, and a proximity switch.

34. An electrical device comprising:

a control circuit, a manually operable mode setting element, having at least two states, locally coupled to the circuit wherein the circuit exhibits at least a normal operational mode and a non-test, service mode in response to the state of the element and wherein the circuit when entering the service mode carries out at least one of a mode indicating transmission to another device and an inhibition of at least one output exhibited when in the normal operational mode.

35. A device as in claim 34 wherein the mode setting element includes a manually movable member which is moved to a service position prior to servicing the respective device wherefor, the at least one output is inhibited during service.

36. A device as in claim 34 which includes interface circuitry for coupling to one of a wireless medium and a wired medium.

37. A device as in claim 34 wherein the control circuitry transmits a status indicating signal to at least one other device each time the mode setting element changes state.

38. A device as in claim 35 which includes a housing wherein the member is carried on a movable portion of the housing.

39. A device as in claim 38 wherein the housing carries an ambient condition sensor.

40. A device as in claim 35 wherein the mode setting element comprises one of a manually operable contact switch and a manually operable non-contact switch.

41. A device as in claim 35 wherein the mode setting element comprises one of a mechanical switch, a magnetic switch, an optical switch and a proximity switch.

42. A device as in claim 35 which includes a housing with a movable cover.

43. A device as in claim 42 wherein removal of the cover causes the mode setting element to change state.

44. A device as in claim 42 wherein the state of the mode setting element is changeable independently of moving the cover.

45. An electrical device comprising:

a control circuit having a normal operating mode and a non-test service mode;

output circuitry, coupled to the control circuit, for exhibiting at least a change of state in response to a selected condition, when the control circuit is in the normal operating mode and not otherwise; and a manually operable mode setting member having at least two states and locally coupled to the control circuit wherein when the member is in one state the control circuit functions in the normal operating mode thereby enabling exhibition of the change of state and wherein when the member is in the other state, the circuit functions in the service mode and no change of state is exhibited until the member is returned to the one state.

46. A device as in claim 45 which includes a transducer which responds to the selected condition and wherein the transducer is coupled to the control circuit.

47. A device as in claim 46 wherein the transducer comprises a sensor of a selected airborne material and wherein the change of state comprises an indication of the presence of sensed material.

48. A device as in claim 47 wherein when in the normal operating mode, the change of state, which is inhibited when in the service mode, indicates the presence of airborne material.

49. A device as in claim 48 wherein the sensor comprises one of a smoke and a gas sensor and wherein the change of state, exhibitable only when in the operating mode, is indicative of an alarm condition.

50. A device as in claim 45 wherein the member comprises a manually settable switch.

51. A device as in claim 50 wherein the switch changes state in response to movement of at least a portion of a cover.

52. A device as in claim 50 wherein the switch comprises one of a mechanical switch, a magnetic switch, an optical switch and a proximity switch.

53. A device as in claim 46 wherein the output circuit carries terminals for attachment to a wire medium and wherein the transducer comprises a smoke sensor, wherein the change of state is indicative of a sensed smoke condition and wherein when the member is in the other state, no smoke indicating change of sate is exhibited.

54. A device as in claim 53 wherein when the change of state is exhibited, a detectable current flow can take place at at least one terminal.

55. A device as in claim 53 wherein when the member is in the one state, a change of state indicative of a sensed smoke condition can be remotely detected but cannot be remotely detected when the member is in the other state.

56. An ambient condition detector comprising:

a sensor;

a control circuit coupled to the sensor;

a manually settable control element, coupled to the control circuit, having at least a first normal on-line, operational state and a second, off-line service sate whereby the control circuit, in response to the element being set to the first state presents a normal operational condition or an alarm condition responsive to sensor output, and, in response to the element being set to the second state presents only a normal operational condition, irrespective of sensor output, until the control element is returned to its first state.

57. A detector as in claim 56 which includes first and second connectors, coupled to the circuit, for attachment to a medium whereby the condition of the control circuit can be sensed remotely.

58. A detector as in claim 57 wherein the condition of the control circuit is indicated by an electrical characteristic at the connectors.

59. A detector as in claim 58 wherein the electrical characteristic corresponds to the presence or absence of a current flow path.

60. A detector as in claim 56 wherein the control element comprises a two state switch.

61. A detector as in claim 60 wherein the state of the switch is altered by one of moving a housing portion, and, subjecting the switch to a magnetic field.

62. A detector as in claim 56 wherein a signal is transmitted by the control circuit indicative of at least one state of the control element.

63. A unit as in claim 1 wherein the switch is selected from a class which includes a mechanically-actuated switch, a magnetically actuated switch, an optically actuated switch, a proximity switch, and a solid state, electrically actuated switch.

64. An electrical unit comprising:

a housing;

control circuitry;

a sensor coupled to the control circuitry;

a manually controlled switch having at least two states;

wherein the control circuitry processes the sensor signals in a normal operational mode when the switch is in one predetermined state and processes the sensor's signals in a non-normal mode when the switch is changed to another predetermined state whereby detection of the sensed condition is inhibited while the unit is in the non-normal mode; and wherein the unit provides an external indicium within a predetermined period to indicate its operational mode.

65. A unit as in claim 64 wherein the control circuitry includes a programmed processor responsive to states of the switch.

66. A unit as in claim 64 wherein processing of the sensor's signals in a non-normal mode is essentially the same as the normal mode except that the provided indicium is different between the modes.

67. A unit as in claim 64 wherein the non-normal mode is a maintenance mode.

68. A unit as in claim 64 wherein the housing carries a movable portion and the state of the switch is responsive to the movable portion.

69. A unit as in claim 68 wherein the movable portion slides.

70. A unit as in claim 64 which includes at least one of an audible and visible indicator to identify the operational mode of the unit.

71. A unit in claim 66 wherein the switch changes state in response to one of a mechanical input, a magnetic input, an optical input, and an electrical input.

72. A unit as in claim 66, wherein the sensor is selected from a class which includes a smoke sensor, a gas sensor, a thermal sensor, a position sensor, a flow sensor, and a motion sensor.

73. A method of operating a multi-device communication system comprising:

operating the system with the devices in a normal operational mode;

manually altering at least a housing portion's position on a selected device thereby placing that device into a non-normal mode;

inhibiting detection of the sensed condition from the selected device while the unit is in the non-normal mode; and continuing to operate the system with the remaining devices in their respective normal operating modes with the selected device operating in the non-normal mode.

74. An electrical unit comprising:

a housing;

a transducer carried by the housing;

control circuitry having at least two states, responsive to transducer condition, and coupled to the transducer;

an interface for connection to an external medium wherein the control circuit is coupled to the interface;

a multi-position switch coupled to the circuitry whereby, when the switch is in a first position, the circuitry, via the interface is on line relative to the medium, and when the switch is in a second position, the circuitry enters an off-line maintenance mode and exhibits only an off-line state irrespective of transducer condition.

75. A unit as in claim 74 wherein in response to a position change, the circuitry externally transmits a selected indicium indicating one of going off-line and coming back on-line.

76. A unit as in claim 75 wherein in the control circuitry includes a programmed processor responsive to the changes of position.

77. A unit as in claim 75 wherein the transducer comprises a sensor and, in response to the presence of a selected ambient condition, the control circuitry enters a condition initiating state and couples this state to the medium when the switch is in the first position, wherein when the switch is in the second, maintenance, position, the presence of the ambient condition is not discernable externally of the unit.

78. A unit as in claim 77 wherein when the housing carries a movable portion and switch position is responsive to the movable portion.

79. A unit as in claim 78 wherein the movable portion is slidably carried on a base.

80. A unit as in claim 74 which includes at least one of an audible indicator of the position and a visible indicator of the positions.

81. A unit as in claim 77 wherein the switch changes state in response to one of a mechanical input, a magnetic input, an optical input and an electrical input.

82. A unit as in claim 77 wherein the sensor is selected from a class which includes a smoke sensor, a gas sensor, a thermal sensor, a position sensor, a flow sensor and a motion sensor.

83. An electrical unit comprising:

a housing;

a transducer carried by the housing;

a control circuit having at least two states, coupled to the transducer and responsive to transducer condition;

a multi-position switch coupled to the circuit whereby, when the switch is in a first position, the circuit can exhibit any one of the states responsive to transducer condition, and when the switch is in second position, the circuit enters a maintenance mode and only exhibits a state that is not responsive to transducer condition;

where it can be externally ascertained of the electrical unit that it is in the maintenance mode.

84. A unit as in claim 83 wherein the switch is carried by the housing.

85. A unit as in claim 83 wherein the switch comprises as a manually movable portion a movable part of the housing.

86. A unit is in claim 83 wherein each of the at least two states of the control circuit are valid as part of normal error-free operation.

87. A unit as in claim 83 wherein said transducer is part of a sensor.

88. A unit as in claim 87 wherein the sensor is an ambient condition sensor.

89. A unit as in claim 88 wherein at least a first state of the control circuit is indicative of the presence of a selected ambient condition being sensed by the ambient condition sensor; and wherein at least a second state of the control circuit is indicative of the presence of a selected ambient condition not being sensed by the ambient condition sensor.

90. A unit as in claim 87 wherein the sensor continues operating when the multi-position switch is in a second position and the control circuitry enters the maintenance mode.

* * * * *